United States Patent [19]

Frosch

[11] Patent Number: 4,566,153

[45] Date of Patent: Jan. 28, 1986

[54] UNIVERSAL TEXTILE MACHINE FOR OPTIONALLY MANUFACTURING LONGITUDINALLY ORIENTED OR RANDOMLY ORIENTED FIBRE FLEECES

[75] Inventor: Werner Frosch, Schwanewede, Fed. Rep. of Germany

[73] Assignee: Hollingsworth GmbH, Fed. Rep. of Germany

[21] Appl. No.: 650,321

[22] Filed: Sep. 12, 1984

[30] Foreign Application Priority Data

Sep. 29, 1983 [DE] Fed. Rep. of Germany ..... 3334912

[51] Int. Cl.[4] ..... D01G 15/12; D01G 15/46

[52] U.S. Cl. ..... 19/98; 19/106 R

[58] Field of Search ..... 19/98, 106 R

[56] References Cited

U.S. PATENT DOCUMENTS 3,012,289 12/1961 Weber ..... 19/106 R
3,364,527 1/1968 Ramo ..... 19/106 R
4,384,388 5/1983 Mondini ..... 19/106 R
4,434,531 3/1984 Mondini ..... 19/106 R

FOREIGN PATENT DOCUMENTS 1047080 12/1958 Fed. Rep. of Germany ..... 19/106
0961511 6/1964 United Kingdom ..... 19/106

*Primary Examiner*—Louis K. Rimrodt
*Attorney, Agent, or Firm*—Townsend and Townsend

[57] ABSTRACT

In a carding machine the distance between the doffer roller and the main cylinder can be adjusted to a distance such that the card clothing of the doffer roller is no longer in its operating position with respect to the main cylinder. Further, there is provided an intermediate roller, which, when the doffer roller has been moved away from the main cylinder, is brought into a position such that its card clothing meshes with the card clothing both of the main cylinder and of the doffer roller.

7 Claims, 4 Drawing Figures

UNIVERSAL TEXTILE MACHINE FOR OPTIONALLY MANUFACTURING LONGITUDINALLY ORIENTED OR RANDOMLY ORIENTED FIBRE FLEECES

BACKGROUND OF THE INVENTION

The invention relates to a universal carding machine for the optional production of either longitudinally fibred fleeces or tangle-fibred fleeces, having a main cylinder and associated carding elements, and also comprising a fibre intake mechanism and a doffer roller.

Such carding machines are well-known in the art and are used to manufacture longitudinally oriented fibre fleece. In another type of textile machines for the production of randomly oriented fibre fleece, a drum following the main cylinder leads to an irregular or random pattern of the fibres by compaction (Melliand Textile Reports 6/1969, page 626). In such a machine, the compacting drum is larger than the doffer roller, and it is not possible to produce longitudinally oriented fibre fleeces with such a machine.

It is also well-known in the art to produce tangled fleeces with the aid of centrifugal forces in small rollers.

It is an object of the invention to provide a universal textile or carding machine, in which both longitudinally oriented and randomly oriented fibre fleeces may be manufactured.

BRIEF SUMMARY OF THE INVENTION

This and other objects are achieved by a textile machine having a supplementary intermediate roller furnished with card clothing and the shaft of which may be positioned to two positions, by a setting mechanism for adjusting the distance between the doffer roller and the main cylinder, by selecting the two positions in such a way that when the doffer roller is put into its operating position relative to the main cylinder its card clothing is separated from the card clothings of the main cylinder and the doffer roller and when the doffer roller is separated from the main cylinder the card clothing of the intermediate roller is in the operating position relative to the card clothings of the main cylinder and of the doffer roller, and by rotating both the main cylinder and the intermediate roller in the same direction.

Depending on the position of the intermediate roller and the doffer roller, therefore, either longitudinally fibred or tangle-fibred fleeces may be produced.

The position of the clothing or the direction into which the tips of the clothing are pointing both of the main cylinder and of the intermediate roller should preferably be the same.

It is also of advantage if the intermediate roller is partially surrounded by a cover plate in order to make sure that all fibres will be transferred on to the doffer roller via the intermediate roller.

To attain the optimum tangled fleece formation it is of advantage to set the peripheral speed of the intermediate roller to between 80 and 200% of the peripheral speed of the main cylinder.

The diameter of the intermediate roller should preferably be smaller than that of the main cylinder and the doffer roller.

In a preferred embodiment the bearings of the shaft of the intermediate roller and the doffer roller are linked by a hinged connection and are guided in guide rails.

BRIEF DESCRIPTION OF THE DRAWINGS

The invention will be more readily understood from the following description of a preferred embodiment and by reference to the accompanying drawings, wherein.

DETAILED DESCRIPTION OF A PREFERRED EMBODIMENT

Figure 1:
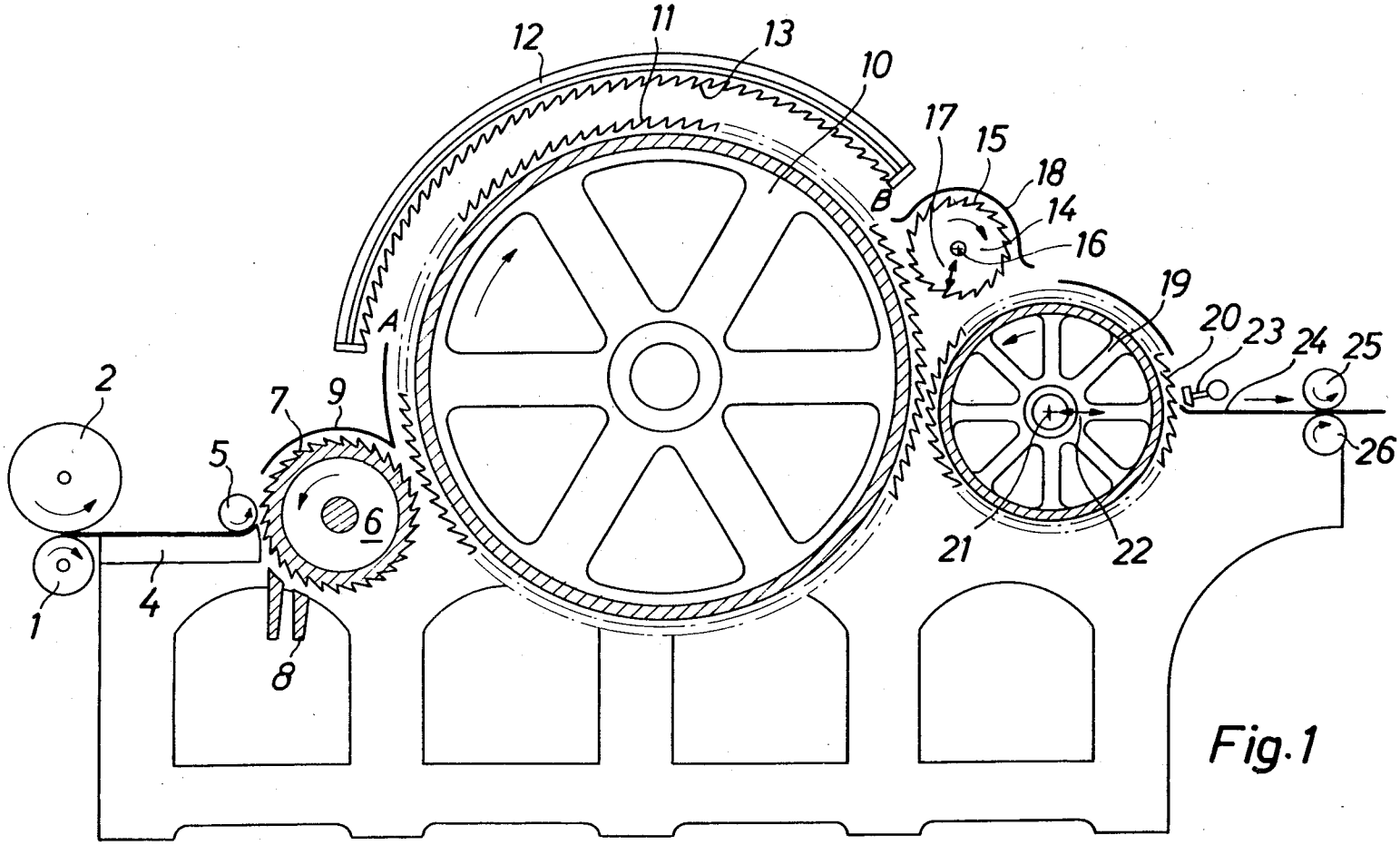
FIG. 1 shows a vertical section through a universal carding machine.
Figure 2:
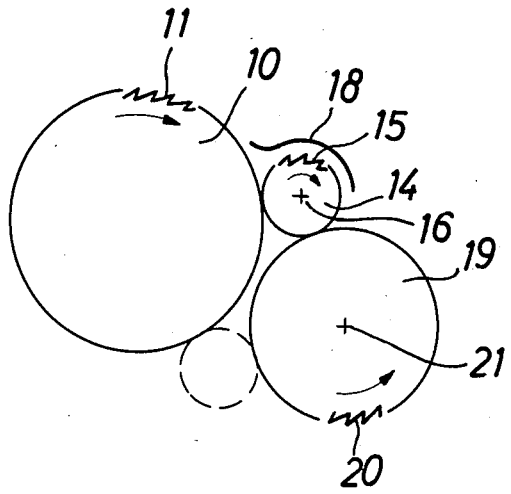
FIG. 2 shows in diagrammatic form the relative position of the rollers for producing a tangle-fibred fleece.

The carding machine shown in FIG. 1 comprises a mechanism for feeding in the fibres consisting of a table 4, adjacent to which is a grooved roller 1, which lies against a fibre lap 2. The sheet of fibres 3 released from the lap 2 is drawn across the table 4 by a feed roller 5 and led to an opening roller 6, the surface of which is furnished with teeth, which catch in the fibre layer 3 and tear fibres or fibre threads out of it and pass them on to the main cylinder 10. During this operation only long fibres are caught, whereas short fibres and waste are being separated by scraper knives and by the centrifugal force generated by the opening roller 6.

The teeth 11 of the main cylinder 10 receive fibres from the opening roller 6, since the peripheral speed of the main cylinder is greater than that of the opening roller.

Part of the circumference of the main cylinder is covered with at least one stationary carding flat 12, the teeth 13 of which are positioned at a short distance from the teeth 11 of the main cylinder. In FIG. 1 the clearance between the carding flat 12 and the main cylinder 10 has been exaggerated for the sake of clarity. Instead of stationary carding flats, similar devices common in the field of cards may be used, e.g. workers, stripping rollers, revolving flat cards and the like.

After leaving the space between the main cylinder 10 and the cover 12 of the sawtooth wire clothing, the fibres are picked up by the doffer roller 19 and thereafter stripped off and led to calender rolls 25 and 26 by a stripper 23 located at the delivery end of the doffer roller 19 and out of the machine as a fibre fleece 24.

The shaft 21 of the doffer roller may be adjusted in the direction indicated by the double arrow 22 (FIG. 1).

In the space at the outlet region of the main cylinder 10 and above the doffer roller 19 an intermediate roller 14 is provided, which is clothed with sawtooth wire 15 and which is partially covered by a cover plate 18 on the side furthest from the rollers. The intermediate roller 14 may be adjusted in the direction shown by the double arrow 17 (FIG. 1).

Figure 3:
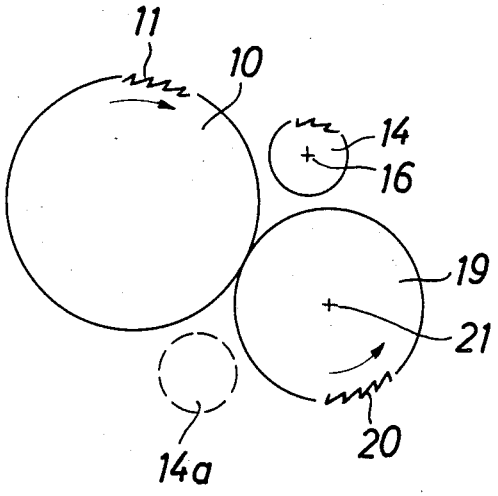
FIG. 3 shows the relative position of the rollers for producing a fleece with longitudinally oriented fibres.

In the relative position of the rollers shown in FIG. 1 and schematically in FIG. 3, the intermediate roller is located in such a position that it does not affect the fibres carried by the main cylinder 10 and the doffer roller 19, and the doffer roller 19 is so close to the main cylinder 10 that it picks up the fibres from it. In this operating position the machine operates like an ordinary card and the fibrous fleece 24 consists mainly of fibres lying longitudinally oriented and in parallel.

In the other operating position, shown schematically in FIG. 3, the doffer roller 19 is distant from the main cylinder and not cooperating with it. Concurrently, the intermediate roller 14 has been brought nearer to the doffer roller 19, so that the card clothing of the intermediate roller 14 picks up fibres from the card clothing of the main cylinder and passes them on to the doffer roller 19.

As may be seen from FIG. 1, the main cylinder 10 and the intermediate roller 14 rotate in the same direction while the doffer roller 19 rotates in the opposite direction.

The circumferential speed of the main cylinder is about 1000 m/min and that of the intermediate roller is about 800 m/min.

It is apparent that in the first operating position, which serves to produce longitudinally oriented fleeces, the main cylinder 10 and the doffer roller 19 rotate in opposite directions and that in the other operating position, which serves to produce tangle-fibred fleeces, only the intermediate roller 14 and the doffer roller 19 rotate in opposite directions, whereas the main cylinder 10 and the intermediate roller 14 rotate in the same direction.

A particularly homogeneous random orientation of the fibres may be attained if the intermediate roller 14 rotates at a relatively high peripheral speed, for example at a speed higher than that of the main cylinder 10, since in that case the fibres are centrifuged off by the high centrifugal force of the main cylinder 10 and are collected by the intermediate roller 14 and therefore intensively tangled.

Figure 4:
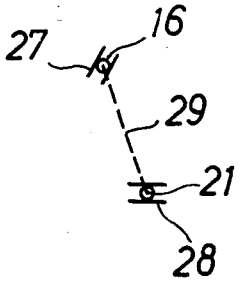
FIG. 4 shows the bearing guides for the bearings of the intermediate roller and the doffer roller.

FIG. 4 shows a linkage for the coordinated adjustment of the shafts 16 and 21 of intermediate roller 14 and doffer roller 19, respectively. The bearings of these shafts are guided in guide rails 27 and 28, respectively, which are oriented in the direction shown by the double arrows 22, 17 in FIG. 1. A link rod 29 (shown as a dotted line) is provided, which links the shafts, so that when the doffer roller 19 is moved away from the main cylinder 10 the intermediate roller 14 is brought closer to both the main cylinder 10 and the doffer roller 19. Other guides and hinged connections may of course also be used.

The carding machine may be made from ordinary carding machines by applying only a slight modification and by the addition of another roller so that only minor constructional changes are required and existing carding machines may be easily converted.

I claim:

1. A universal textile machine for optionally manufacturing a longitudinally oriented or a randomly oriented fibre fleece, comprising:

a main cylinder and associated carding elements;

a fibre feed-in-mechanism;

a doffer roller adjacent said main cylinder;

an additional intermediate roller furnished with a card clothing and located close to the contacting area of said main cylinder and said doffer roller upstream of the fibre flow;

a setting mechanism for varying the clearance between said doffer roller and said main cylinder, said intermediate roller being shiftable into two positions, in the first of said two positions the intermediate roller cooperating with both said main cylinder and said doffer roller, and in the other of said two positions the intermediate roller being distant from said main cylinder and said doffer roller, said doffer roller being distant from said main cylinder in said first position of the intermediate roller, and said doffer roller adjoining said main cylinder in said second position of the intermediate roller, and said main cylinder and said intermediate roller having the same direction of rotation.

2. A textile machine as claimed in claim 1, wherein the position of the card clothing of the main cylinder and of the intermediate roller is identical.

3. A textile machine as claimed in claim 1, wherein the intermediate roller is partly surrounded by a cover plate.

4. A textile machine as claimed in claim 1, wherein the peripheral speed of the intermediate roller is between 80% and 200% of the peripheral speed of the main cylinder.

5. A textile machine as claimed in claim 1, wherein the diameter of the intermediate roller is smaller than that of the main cylinder and that of the doffer roller.

6. A textile machine as claimed in claim 1, wherein the shaft bearings of the intermediate roller and the doffer roller are linked by a hinged connection and are guided in guide rails.

7. A universal textile machine for optionally manufacturing a longitudinally oriented or a randomly oriented fibre fleece comprising:

a main cylinder and associated carding elements;

a fibre feed-in-mechanism;

a doffer roller adjacent said main cylinder;

an additional intermediate roller furnished with a card clothing and located close to the contacting area of said main cylinder and said doffer roller upstream of the fibre flow;

a first setting mechanism for varying the clearance between said doffer roller and said main cylinder, said doffer roller being shiftable into two positions, in the first of said two positions the doffer roller adjoining said main cylinder and distant from said intermediate roller, and in the second of said two positions the doffer roller being distant from said main cylinder and adjoining said intermediate roller;

a second setting mechanism for varying the clearance between said intermediate roller and said main cylinder, said intermediate roller being shiftable into two positions, in the first of said two positions the intermediate roller being distant from said doffer roller and said main cylinder, and in the second of said two positions the intermediate roller adjoining said main cylinder and said doffer roller and having the same direction of rotation as said main cylinder, so that in the first of said two positions a longitudinally-oriented fibre fleece is produced, and in the second of said two positions a randomly-oriented fibre fleece is produced.

* * * * *